US009951291B2

(12) United States Patent
Erdemir et al.

(10) Patent No.: US 9,951,291 B2
(45) Date of Patent: Apr. 24, 2018

(54) PRODUCING CARBON-BASED BOUNDARY FILMS FROM CATALYTICALLY ACTIVE LUBRICANT ADDITIVES

(71) Applicant: UChicago Argonne, LLC, Chicago, IL (US)

(72) Inventors: Ali Erdemir, Naperville, IL (US); Anil U. Mane, Naperville, IL (US); Jeffrey W. Elam, Elmhurst, IL (US); Giovanni Ramirez, Argonne, IL (US); Osman Eryilmaz, Argonne, IL (US)

(73) Assignee: UChicago Argonne, LLC, Chicago, IL (US)

( * ) Notice: Subject to any disclaimer, the term of this patent is extended or adjusted under 35 U.S.C. 154(b) by 180 days.

(21) Appl. No.: 14/720,021

(22) Filed: May 22, 2015

(65) Prior Publication Data

US 2016/0340602 A1 Nov. 24, 2016

(51) Int. Cl.

| | |
|---|---|
| ***C10M 169/04*** | (2006.01) |
| ***C10M 139/06*** | (2006.01) |
| ***C10M 129/24*** | (2006.01) |

(52) U.S. Cl.

CPC .... *C10M 169/04* (2013.01); *C10M 2201/062* (2013.01); *C10M 2205/0285* (2013.01); *C10M 2207/2805* (2013.01); *C10M 2207/401* (2013.01); *C10M 2209/1033* (2013.01); *C10M 2227/081* (2013.01); *C10M 2227/09* (2013.01); *C10M 2229/025* (2013.01); *C10N 2210/01* (2013.01); *C10N 2210/02* (2013.01); *C10N 2210/03* (2013.01); *C10N 2210/04* (2013.01); *C10N 2210/05* (2013.01); *C10N 2210/06* (2013.01); *C10N 2210/07* (2013.01); *C10N 2210/08* (2013.01); *C10N 2230/06* (2013.01)

(58) Field of Classification Search

CPC combination set(s) only.
See application file for complete search history.

(56) References Cited

U.S. PATENT DOCUMENTS

| | | | | |
|---|---|---|---|---|
| 3,925,213 | A | 12/1975 | Froeschmann et al. | |
| 4,292,186 | A | 9/1981 | Chibnik et al. | |
| 4,981,602 | A * | 1/1991 | Ripple | C10M 141/10 508/237 |
| 2013/0085088 | A1 | 4/2013 | Erdemir et al. | |

FOREIGN PATENT DOCUMENTS

WO WO-2012/078151 6/2012

OTHER PUBLICATIONS

Peter G. Gordon et al, ECS Journal of Solid State Science and Technology, Trends in Copper Precursor Development for CVD and ALD Applications, published Dec. 9, 2014.

* cited by examiner

*Primary Examiner* — Prem C Singh
*Assistant Examiner* — Chantel Graham
(74) *Attorney, Agent, or Firm* — Foley & Lardner LLP

(57) ABSTRACT

A lubricant composition includes an oil including a plurality of long-chain hydrocarbon molecules. A quantity of a catalytically active metal-organic additive is mixed with the oil. The metal-organic additive is formulated to fragment the long-chain hydrocarbon molecules of the oil into at least one of dimers and trimers under the influence of at least one of a mechanical loading and a thermal loading. In some embodiments, the metal-organic additive includes a compound of formula II:

(II)

where:

X is Sc, Ti, V, Cr, Mn, Fe, Co, Ni, Cu, Zn, Y, Zr, Nb, Mo, Tc, Ru, Rh, Pd, Ag, Cd, Hf, Ta, W, Re, Os, Ir, Pt, Au, Hg, Rf, Db, Sg, Bh, Hs, Mt, Ds, Rg or Cn, and $R_1$, $R_2$, $R_3$ and $R_4$ are alkyl or alkyl halide.

22 Claims, 9 Drawing Sheets

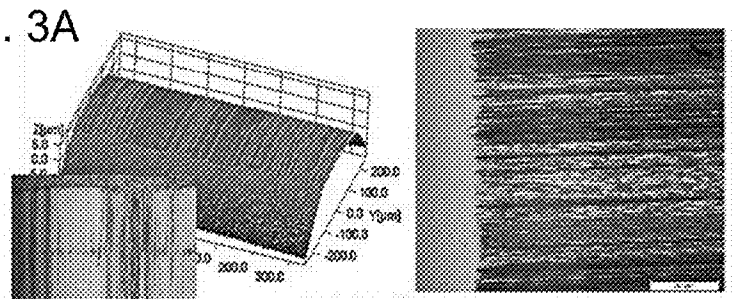
FIG. 3A
PAO 10
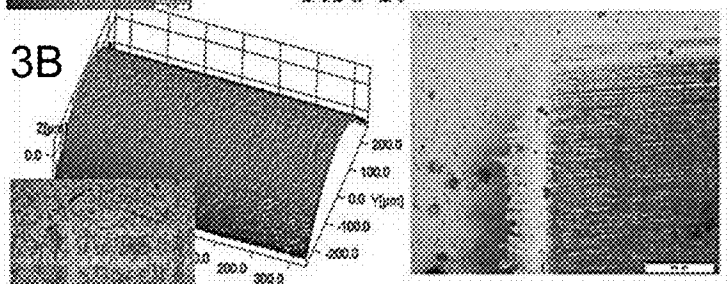
FIG. 3B
PAO 10 + Ni
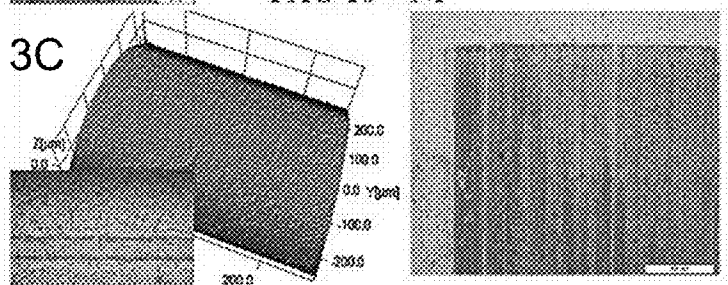
FIG. 3C
Fully Formulated Oil
FIG. 3D
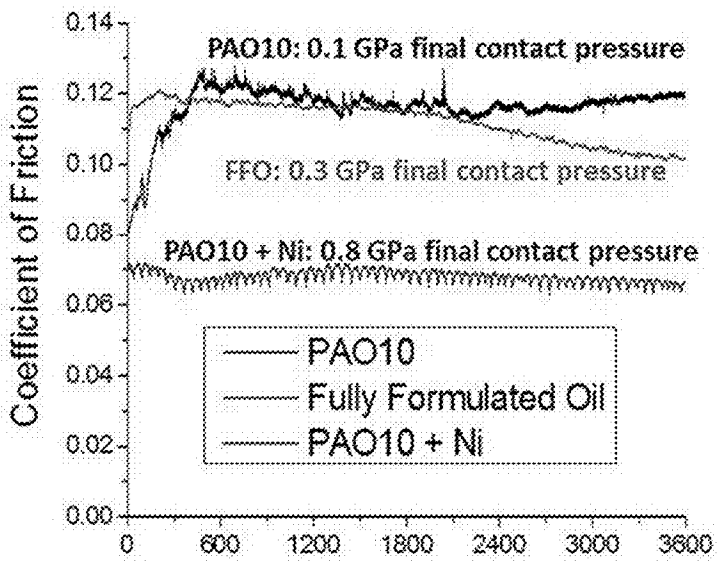
Friction Coefficient and Wear of test using PAO 10, Fully formulated Oil and PAO 10 + Ni molecule

PRODUCING CARBON-BASED BOUNDARY FILMS FROM CATALYTICALLY ACTIVE LUBRICANT ADDITIVES

The United States Government claims certain rights in this invention pursuant to Contract No. W-31-109-ENG-38 between the United States Government and the University of Chicago and/or pursuant to DE-AC02-06CH11357 between the United States Government and UChicago Argonne, LLC representing Argonne National Laboratory.

TECHNICAL FIELD

The present disclosure relates generally to methods of formulating lubricants.

BACKGROUND

Lubricating oils such as, for example engine oils and greases typically include conventional additives to enhance lubrication properties. Conventional additives such as, for example, the ZDDP and MoTDC can be detrimental to effective operation of catalytic converters and other after-treatment devices for engines which use lubricants containing such additives. This results in ineffective and incomplete operation of such devices leading to increase in environmental pollution. While solid lubricants can be deposited on surfaces of components requiring lubrication (e.g., engine components such as piston-cylinder of an IC engine, transmission gears, tie-rod assembly, etc.), deposition of such solid lubricants can be expensive, cumbersome and difficult to scale-up to integrate with large scale manufacturing operations.

SUMMARY

Embodiments described herein relate generally to lubricant compositions, and in particular to oil based lubricant compositions that include one or more catalytically active metal-organic additives mixed therein. The metal organic-additives are formulated to fragment the long-chain hydrocarbons of the oil into dimers and trimers under the influence of a mechanical loading and/or thermal loading so that a carbon-based boundary film is deposited on a surface on which the lubricant is disposed thereby, providing a robust and long-lasting lubricant layer on the surface.

In some embodiments, a lubricant composition includes an oil including a plurality of long-chain hydrocarbon molecules. A quantity of a catalytically active metal-organic additive is mixed with the oil. The metal-organic additive is formulated to fragment the long-chain hydrocarbon molecules of the oil into at least one of dimers and trimers under the influence of at least one of a mechanical loading and a thermal loading. In some embodiments, the metal-organic additive includes a compound of formula II:

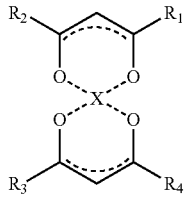

(II)

where:

X is Sc, Ti, V, Cr, Mn, Fe, Co, Ni, Cu, Zn, Y, Zr, Nb, Mo, Tc, Ru, Rh, Pd, Ag, Cd, Hf, Ta, W, Re, Os, Ir, Pt, Au, Hg, Rf, Db, Sg, Bh, Hs, Mt, Ds, Rg or Cn, and $R_1$, $R_2$, $R_3$ and $R_4$ are alkyl or alkyl halide.

In some embodiments, an apparatus comprises a first member including a first surface. A lubricant is disposed on the first surface. The lubricant includes an oil including a plurality of long-chain hydrocarbon molecules. A quantity of a catalytically active metal-organic additive is mixed with the oil. A second member including a second surface is positioned on the lubricant disposed on the first surface. The second member is configured to displace relative to the first surface such that the first surface slides on the lubricant during the displacing. The metal-organic additive is formulated to fragment the long-chain hydrocarbon molecules of the oil into at least one of dimers and trimers under influence of at least one of a mechanical loading and a thermal loading between the first surface and the second surface. In some embodiments, the metal organic additive includes the compound of formula II.

In some embodiments, a method of preparing a lubricant includes providing an oil including a plurality of long-chain hydrocarbon molecules. A predetermined quantity of a catalytically active metal-organic additive is added to the oil. The metal-organic additive is formulated to fragment the long-chain hydrocarbon molecules of the oil into at least one of dimers and trimers under the influence of at least one of a mechanical loading and a thermal loading. The metal-organic additive is mixed with the oil to homogenously distribute the metal-organic additive in the oil. In some embodiments, the metal-organic additive includes a compound of formula II.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

BRIEF DESCRIPTION OF DRAWINGS

The foregoing and other features of the present disclosure will become more fully apparent from the following description and appended claims, taken in conjunction with the accompanying drawings. Understanding that these drawings depict only several implementations in accordance with the disclosure and are therefore, not to be considered limiting of its scope, the disclosure will be described with additional specificity and detail through use of the accompanying drawings.

FIGS. 3A-3C are 3-dimensional (3D) profilometry profiles and optical images of the second surface of the second member (left panels), and optical images of the first surface of the first member (right panels) of FIG. 2 after sliding the second surface on the first surface while the first member is reciprocating with various lubricants disposed therebetween; FIG. 3D is a plot of friction coefficient of the first surface due to each of the various lubricants used in FIGS. 3A-3C.

Figure 1:
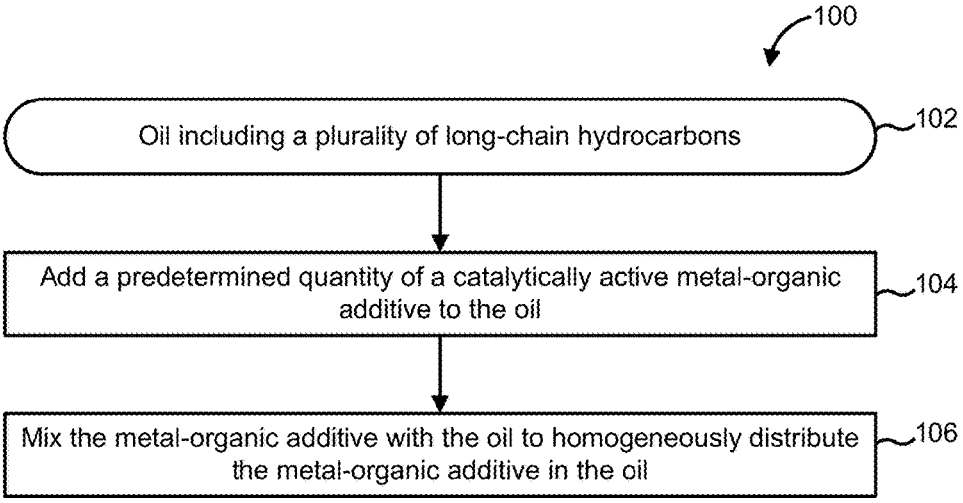
FIG. 1 is a schematic flow diagram of a method of preparing a lubricant that includes a catalytically active metal-organic additive, according to an embodiment.

Reference is made to the accompanying drawings throughout the following detailed description. In the drawings, similar symbols typically identify similar components, unless context dictates otherwise. The illustrative implementations described in the detailed description, drawings, and claims are not meant to be limiting. Other implementations may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

DETAILED DESCRIPTION OF VARIOUS EMBODIMENTS

Embodiments described herein relate generally to lubricant compositions, and in particular to oil based lubricant compositions that include one or more catalytically active metal-organic additives mixed therein. The metal organic-additives are formulated to fragment the long-chain hydrocarbons of the oil into dimers and trimers under the influence of mechanical and/or thermal loading so that a carbon-based boundary film is deposited on a surface on which the lubricant is disposed thereby, providing a robust and long-lasting lubricant layer on the surface.

Embodiments of the lubricants including the catalytically active metal-organic additives may provide several benefits including, for example: (1) providing a simple method of mixing a small quantity of a catalytically active metal-organic additive in an oil to form a superior quality lubricant; (2) enabling fragmenting of long-chain hydrocarbons of the oil included in the lubricant into dimers and trimers such that a boundary film of carbon-based dimers and trimers is deposited on a surface on which the lubricant is disposed under the influence of mechanical and/or thermal loading such as when the surface is sliding or rubbing against another surface; (3) providing robust and long lasting lubrication with a lower coefficient of friction relative to conventional lubricants; and (4) allowing relatively facile and low cost manufacturing as well as easy integration with existing systems.

In some embodiments, a lubricant composition includes an oil including a plurality of long-chain hydrocarbon molecules. Any suitable oil can be used. In various embodiments, the oil can include a paraffinic oil, a naphthenic oil or an aromatic oil. In some embodiments, the oil can include a petroleum based oil or otherwise a mineral oil. In some embodiments, the oil can include a vegetable oil or a synthetic oil such as a hydrogenated PAO oil, an ester based oil, a silicone based oil, plant or vegetable oils, polyalkylene glycols or a fluorocarbon based oil. In some embodiments, any one of a Group I oil, a Group II oil, a Group III oil, a Group IV oil or a Group V oil as defined by the American Petroleum Institute (API) can be used. In particular embodiments, the oil includes a PAO oil.

In various embodiments, the oil can include fully formulated oils. As used herein, the term "fully formulated" refers to oils that include any pre-prepared oil formulation which can be used as is. Such fully formulated oils can include, for example commercially available natural, semi-synthetic or synthetic oils (e.g., commercially available oils such as MOBIL1®, CASTROL® series oils, CASTROL GTX® series oils, VALVOLINE® series oils, VALVOLINE SYNPOWER® oil, PENNZOIL® series oils; YAMAHA® series oils, NULON® series oils, HAVOLINE® series oils, or any other commercially available fully formulated oil).

A quantity of a catalytically active metal-organic additive is mixed with the oil. As used herein, the term "catalytically active" means that the metal-organic additive catalyzes the decomposition of the oil, for example, cracks the long-chain hydrocarbons included in the oil into smaller hydrocarbons such as dimers and trimers, catalyzes the breaking of C—H and/or C—C bonds of the long-chain hydrocarbon molecules. Alternatively, the metal-organic additive might itself decompose on a surface through rubbing action to yield a decomposition product which in turn is catalytically active towards breaking C—H and/or C—C bonds in the oil.

In some embodiments, the quantity of the catalytically active additive in the oil is in the range of 50 ppm to 1,000 ppm (e.g., 50, 60, 70, 80, 90, 100, 200, 300, 400, 500, 600, 700, 800, 900 or 1,000 ppm inclusive of all ranges and values therebetween). In other embodiments, the quantity of the catalytically active metal-organic additive added to the oil can be in the range of about 0.1% weight by volume (w/v) to about 5% w/v (e.g., 0.1%, 0.2%, 0.3%, 0.4%, 0.5%, 0.6%, 0.7%, 0.8%, 0.9%, 1.0%, 2%, 3%, 4% or 5% inclusive of all ranges and values therebetween).

The metal-organic oil is formulated to fragment at least a portion of the long-chain hydrocarbons of the oil into at least one of dimers and trimers under the influence of mechanical and/or thermal loading. For example, the mechanical loading at which the metal-organic additive fragments the long-chain hydrocarbons can be in the range of 20 MPa to 5 GPa (e.g., 20 MPa, 40 MPa, 60 MPa, 80 MPa, 100 MPa, 200 MPa, 300 MPa, 400 MPa, 500 MPa, 600 MPa, 700 MPa, 800 MPa, 900 MPa, 1 GPa, 2 GPa, 3 GPa, 4 GPa or 5 GPa inclusive of all ranges and values therebetween). Furthermore, the thermal loading or temperature at which the metal-organic additive fragments the long-chain hydrocarbons can be in the range of 20 degrees Celsius to 300 degrees Celsius (e.g., 20, 30, 40, 50, 60, 70, 80, 90, 100, 120, 140, 160, 180, 200, 220, 240, 260, 280 or 300 degrees Celsius inclusive of all ranges and values therebetween). In particular embodiments, the metal-organic oil is formulated to fragment at least a portion of the long-chain hydrocarbons of the oil into at least one of dimers and trimers under the influence of each of the mechanical loading and thermal loading.

The catalytically active metal-organic additive fragments the long-chain hydrocarbons of the oil into carbon based dimers and/or trimers or otherwise carbon particles, which are deposited on a surface on which the lubricant is disposed. Furthermore, a thin layer of the metal or otherwise a metal oxide, metal halide, metal nitride, metal carbide or metal sulfide included in the metal-organic compound or resulting from decomposition of the organic compound can also be deposited on the surface. In this manner, a carbon-based and/or metal-based boundary film is disposed on the surface which provides a robust and long-lasting lubrication on the surface in addition to the oil (e.g., PAO oil) included in the lubricant composition. In some embodiments, the catalytic activity can be enhanced by adding multiple metals-organic additives to the lubricant. Furthermore, the selectivity of the catalyst can be adjusted by varying the metal and/or the functional ligand bound to the one or more metals included in the metal-organic catalyst such that the additive is more catalytically active, for instance, to cracking C—C bonds versus cracking C—H bonds.

The metal-organic additive can be in solid, liquid, or gaseous form so long as it dissolves in the oil or forms a suspension of particulates small enough so as not to affect the properties of the oil while still facilitating catalytic formation of the lubricating film.

The metal-organic additive includes a catalytic metal, for example a transition metal such as Sc, Ti, V, Cr, Mn, Fe, Co, Ni, Cu, Zn, Y, Zr, Nb, Mo, Tc, Ru, Rh, Pd, Ag, Cd, Hf, Ta, W, Re, Os, Ir, Pt, Au, Hg, Rf, Db, Sg, Bh, Hs, Mt, Ds, Rg or Cn.

In some embodiments, the metal-organic additive can be an inorganic compound which does not include carbon. For example, the metal-organic additive includes a compound of formula I:

$$(X_nR_y)_z \quad (I)$$

where:

X is Sc, Ti, V, Cr, Mn, Fe, Co, Ni, Cu, Zn, Y, Zr, Nb, Mo, Tc, Ru, Rh, Pd, Ag, Cd, Hf, Ta, W, Re, Os, Ir, Pt, Au, Hg, Rf, Db, Sg, Bh, Hs, Mt, Ds, Rg or Cn;

n is 1, 2 or 3;

R is Cl, Br, I, F, O, C, S, SH or N;

y is 1, 2 or 3; and z is 1, 2 or 3.

For example, the metal-organic additive of formula I can include $NiCl_2$, $(CuCl)_3$, $AgCl_3$, AgBr, $AuCl_3$, $PdCl_2$, $TiCl_4$, $FeCl_2$, or any other metal-organic additive of formula I.

In some embodiments, the metal-organic additive includes a metal beta-diketonate. For example, the metal-organic additive can include a compound of formula II:

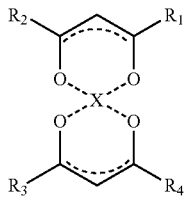

(II)

where:

X is Sc, Ti, V, Cr, Mn, Fe, Co, Ni, Cu, Zn, Y, Zr, Nb, Mo, Tc, Ru, Rh, Pd, Ag, Cd, Hf, Ta, W, Re, Os, Ir, Pt, Au, Hg, Rf, Db, Sg, Bh, Hs, Mt, Ds, Rg or Cn; and $R_1$, $R_2$, $R_3$ and $R_4$ are alkyl or alkyl halide.

Expanding further, $R_1$, $R_2$, $R_3$ and $R_4$ can include any alkyl species, for example methyl-, ethyl-, propyl-, or tert-butyl-, or any alkyl halide species, for example trifluoromethyl-, pentafluoroethyl, or heptafluoropropyl. In various embodiments, $R_1$, $R_2$, $R_3$ and $R_4$ can be the same or different.

In particular embodiments, X is Ni or Cu. For example, the compound of formula II can include any one of the following compounds:

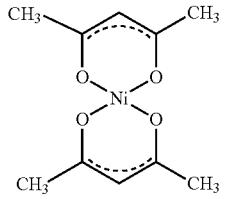

$Ni(acac)_2$

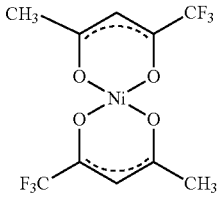

$Ni(tfac)_2$

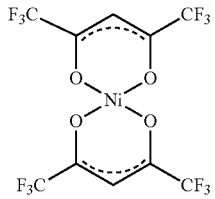

$Ni(hfac)_2$

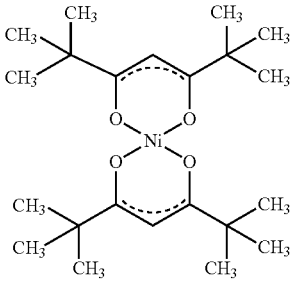

$Ni(thd)_2$

The Ni in the above compounds can be replaced with any other transition metal, for example, one of the 3d transition elements in the periodic table. For example, the Ni can be replaced with Cu to obtain the following compounds which can be used as the metal-organic additive:

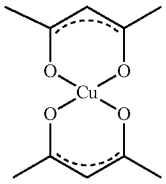

Cu(acac)$_2$

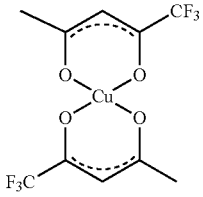

Cu(tfac)$_2$

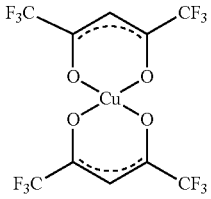

Cu(hfac)$_2$

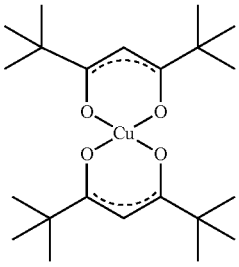

Cu(thd)$_2$

Such beta-diketonate ligand compounds are generally subliming solids and liquids. In some embodiments, various functional groups or otherwise ligands can be added to the beta-diketonate structure to change the reactivity, sublimation rate and/or decomposition temperature of the metal-organic additive and thereby the lubricant composition. The metal-organic additives can be heteroleptic (i.e., have two different functional groups) so that every metal center can be chelated by the same or different two or three diketonate ligands.

In some embodiments, the metal-organic additive can include at least one of $(XR)_3$, $X(dmae)_2$, $X(dmap)_2$, $X(deap)_2$, $X(OCR_2CH_2NHR')_2$, $[X(sBu\text{-}amd)]_2$, $[X(iPr\text{-}amd)]_2$, $[X(iPr\text{-}guan)]_2$, $[X(dtip)]_2$, X(dki)(vtms), X(hfac)(vtms), X(hfac)(vtmos), X(nhc)(hmds) and $[X(hmds)]_4$, where:

X is Sc, Ti, Y, Cr, Mn, Fe, Co, Ni, Cu or Zn;

R and R' are alkyl or alkyl halide.

For example, in various embodiments, the metal-organic additive can include any one of the following compounds. It is to be noted that the Cu in the following compounds can be replaced with any of the 3d transition metals, for example Sc, Ti, Y, Cr, Mn, Fe, Co, Ni or Zn.

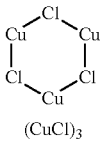

(CuCl)$_3$

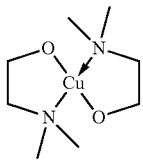

Cu(dmae)$_2$

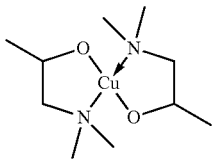

Cu(dmap)$_2$

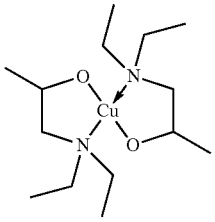

Cu(deap)$_2$

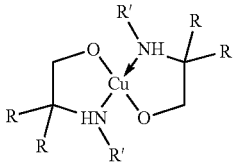

Cu(OCR$_2$CH$_2$NHR')$_2$

-continued

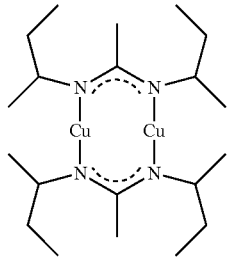

[Cu(sBu-amd)]$_2$

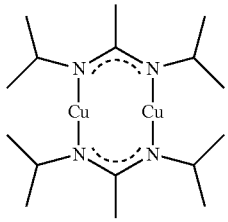

[Cu(iPr-amd)]$_2$

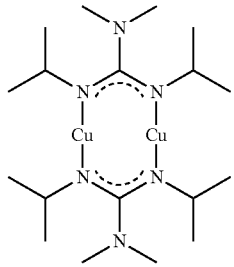

[Cu(iPr-guan)]$_2$

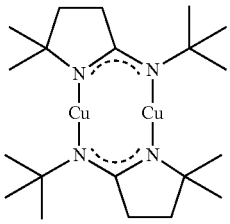

[Cu(dtip)]$_2$

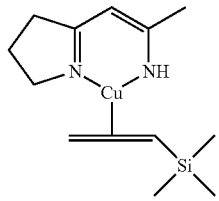

Cu(dki)(vtms)

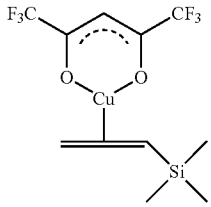

Cu(hfac)(vtms)

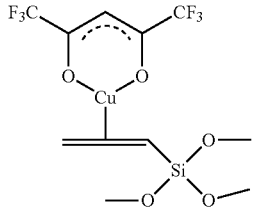

Cu(hfac)(vtmos)

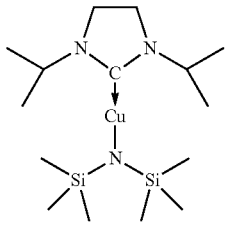

Cu(nhc)(hmds)

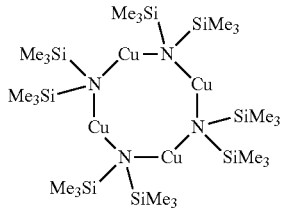

[Cu(hmds)]$_4$

In some embodiments, the metal-organic additive can include a compound of formula III:

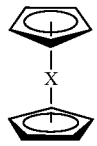

(III)

where:

X is Sc, Ti, V, Cr, Mn, Fe, Co, Ni, Cu, Zn, Y, Zr, Nb, Mo, Tc, Ru, Rh, Pd, Ag, Cd, Hf, Ta, W, Re, Os, Ir, Pt, Au, Hg, Rf, Db, Sg, Bh, Hs, Mt, Ds, Rg or Cn.

In some embodiments, X is Ni such that the metal-organic additive can include bis(cyclopentadienyl)nickel(II) having the following chemical formula:

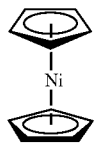

In some embodiments, the metal-organic additive can include a compound of formula IV:

(IV)

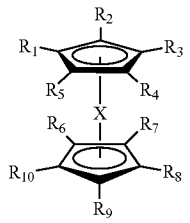

where:

X is Sc, Ti, V, Cr, Mn, Fe, Co, Ni, Cu, Zn, Y, Zr, Nb, Mo, Tc, Ru, Rh, Pd, Ag, Cd, Hf, Ta, W, Re, Os, Ir, Pt, Au, Hg, Rf, Db, Sg, Bh, Hs, Mt, Ds, Rg or Cn; and $R_1$, $R_2$, $R_3$, $R_4$, $R_5$, $R_6$, $R_7$, $R_8$, $R_9$, and $R_{10}$ are alkyl or alkyl halide.

For example, in one embodiment the metal-organic additive can include a compound having the following formula:

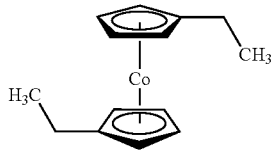

In various embodiments, the lubricant composition can include a combination of the metal-organic additives described herein, for example any combination of the compound of formula I, formula II, formula III, formula IV or any other metal-organic additive described herein. In various implementations, the actual metal-organic additive or combination of metal-organic additive included in the lubricant composition, as well as the amount of the metal-organic additive added to the oil can be based on the specific application (e.g., the material or texture of the surfaces on the which the lubricant composition will be disposed, the force exerted on the surfaces in contact, the environmental sealing of the surfaces, etc.) for which the lubricant composition will be used.

In some embodiments, the lubricant composition can also include any other additive to improve physical and or chemical properties of the lubricant composition such as boiling point, freezing and pour points, viscosity index, thermal stability, hydraulic stability, demulsibility, friction, wear, and extreme pressure capability, corrosion and oxidation resistance. Such additives can include, for example, antioxidants (e.g., phenylenediamines, methylphenols, butylphenols, etc.), surfactants, detergents, anti-wear additives, corrosion or rust inhibitors, micro and nano-colloidal solid particle additives, pressure resistant additives, anti-foaming agents, viscosity index modifiers, demulsifying or emulsifying additives and complexing agents.

FIG. 1 is a schematic flow diagram of an exemplary method 100 for preparing a lubricant composition according to an embodiment. The lubricant composition can be used in any system that includes moving parts, for example, as an automotive oil (e.g., a gasoline engine oil, a diesel engine oil, a natural gas engine oil, a dual-fuel engine oil, a gear box oil, a transmission oil, a brake fluid, a hydraulic fluid, a tractor all-purpose oil, any motor oil, or a two-stroke engine oil), an industrial lubricant, a hydraulic oil, an air compressor oil, a gas compressor oil, a bearing and circulating system oil, a refrigerator compressor oil, a steam and gas turbine oil, an aviation oil, a marine oil, a piston engine oil, a cross-head cylinder oil, a stern tube lubricant, a plunger oil, a reciprocating or centrifugal engine, or used in any other system or machinery that includes surfaces in mutual contact or otherwise can derive any other benefit from the lubricant composition.

The method 100 includes providing an oil or otherwise a liquid lubricant that includes a plurality of long-chain hydrocarbons. Any suitable oil can be used. In various embodiments, the oil can include a paraffinic oil, a naphthenic oil or an aromatic oil. In some embodiments, the oil can include a petroleum based oil or otherwise a mineral oil. In some embodiments, the oil can include a vegetable oil or a synthetic oil such as a hydrogenated PAO oil, an ester based oil, a silicone based oil, plant or vegetable oils, polyalkylene glycols or a fluorocarbon based oil. In some embodiments, any one of a Group I oil, a Group II oil, a Group III oil, a Group IV oil or a Group V oil as defined by the American Petroleum Institute (API) can be used. In particular embodiments, the oil includes a PAO oil. In various embodiments, the oil can include a fully formulated oils as described before herein.

A predetermined quantity of a catalytically active metal-organic additive is added to the oil at 104. For example, the quantity of the catalytically active metal-organic additive added to the oil can be in the range of about 0.1% weight by volume (w/v) to about 5% w/v (e.g., 0.1%, 0.2%, 0.3%, 0.4%, 0.5%, 0.6%, 0.7%, 0.8%, 0.9%, 1.0%, 2%, 3%, 4% or 5% inclusive of all ranges and values therebetween). In other implementations, the quantity of the catalytically active additive in the oil is in the range of 50 ppm to 1,000 ppm (e.g., 50, 60, 70, 80, 90, 100, 200, 300, 400, 500, 600, 700, 800, 900 or 1,000 ppm inclusive of all ranges and values therebetween).

The metal-organic oil is formulated to fragment at least a portion of the long-chain hydrocarbons of the oil into at least one of dimers and trimers under the influence of mechanical and/or thermal loading (e.g., mechanical loading and thermal loading). For example, the mechanical loading at which the metal-organic additive fragments the long-chain hydrocarbons can be in the range of 20 MPa to 5 GPa (e.g., 20 MPa, 40 MPa, 60 MPa, 80 MPa, 100 MPa, 200 MPa, 300 MPa, 400 MPa, 500 MPa, 600 MPa, 700 MPa, 800 MPa, 900 MPa, 1 GPa, 2 GPa, 3 GPa, 4 GPa or 5 GPa inclusive of all ranges and values therebetween). Furthermore, the thermal loading or temperature at which the metal-organic additive fragments the long-chain hydrocarbons can be in the range of 20 degrees Celsius to 300 degrees Celsius (e.g., 20, 30, 40, 50, 60, 70, 80, 90, 100, 120, 140, 160, 180, 200, 220, 240, 260, 280 or 300 degrees Celsius inclusive of all ranges and values therebetween).

The catalytically active metal-organic additive fragments the long-chain hydrocarbons of the oil into carbon based dimers and/or trimers or otherwise carbon particles, which are deposited on a surface on which the lubricant is disposed. Furthermore, a thin layer of the metal or otherwise a metal oxide, metal halide, metal nitride, metal carbide or metal sulfide included in the metal-organic compound can also be deposited on the surface. In this manner, a carbon-based and/or metal-based boundary film is disposed on the surface which provides a robust and long-lasting lubrication on the surface in addition to oil included in the lubricant composition. In some embodiments, the catalytic activity can be enhanced by adding multiple metals-organic additives to the lubricant. Furthermore, the selectivity of the catalyst can be adjusted by varying the metal and the functional ligand of the system.

The metal-organic additive includes a compound of a catalytic metal, for example a transition metal such as Sc, Ti, V, Cr, Mn, Fe, Co, Ni, Cu, Zn, Y, Zr, Nb, Mo, Tc, Ru, Rh, Pd, Ag, Cd, Hf, Ta, W, Re, Os, Ir, Pt, Au, Hg, Rf, Db, Sg, Bh, Hs, Mt, Ds, Rg or Cn. In some embodiments, the metal-organic additive can include a compound of formula I, formula II, formula III, formula IV or any other metal-organic additive described above with respect to the lubricant composition. The impact that the various metal-organic additives described herein have on the friction co-efficient of the surfaces on which a lubricant composition including the various metal-organic additive described herein are disposed, can be a function of the inherent catalytic activity of the particular metal-organic additive.

The metal-organic oil is mixed with the oil to homogenously distribute the metal-organic additive in the oil at 106. For example, the mixture of the metal-organic additive and the oil can be shaken, stirred, sonicated (e.g., subjected to ultrasonication), whirled or mixed using any other mixing method. The mixing can also promote fragmenting of the long-hydrocarbon chains of the oil by the catalytically active metal-organic additive into carbon dimers and/or trimers as described before. The carbon particles and/or metal particles (e.g. pure metal, metal oxide, metal nitride, metal carbide or metal sulfide) can be homogenously distributed in the lubricant composition such that when the lubricant composition is disposed on a surface, a carbon-based film, a metal-based film or a combination thereof is formed on the surface. The film in combination with the oil in the lubricant composition provides a lower coefficient of friction, and a more stable and long lasting lubricant.

Any other additives can also be mixed with the lubricant such as antioxidants (e.g., phenylenediamines, methylphenols, butylphenols, etc.), surfactants, anti-wear additives, corrosion or rust inhibitors, pressure resistant additives, anti-foaming agents, viscosity index modifiers, demulsifying or emulsifying additives and complexing agents.

Figure 2:
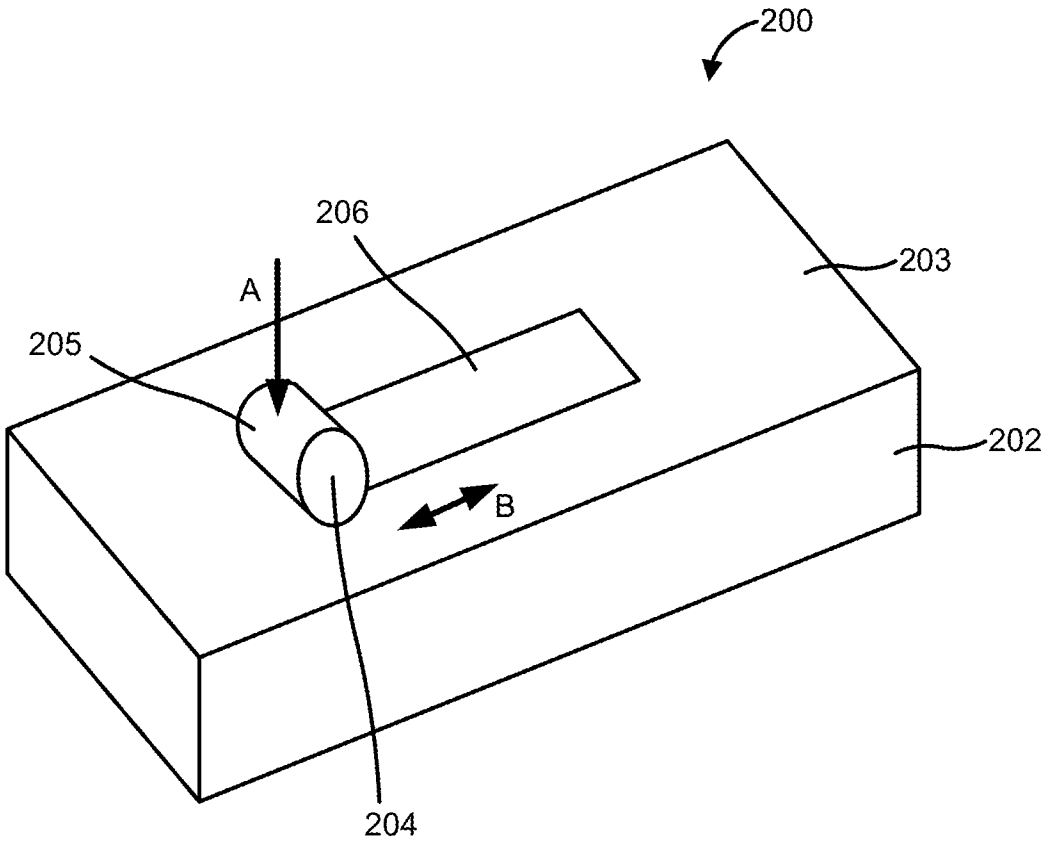
FIG. 2 is a perspective view of an embodiment of an apparatus that includes a first member having a flat first surface, the lubricant prepared using the method of FIG. 1 is disposed on the first surface and a second member having a rounded second surface is positioned on and in contact with the lubricant disposed on the first surface. The first member is configured to reciprocate while the second surface is stationary and contacting the first surface of the first member, and displaced by sliding against the second surface because of a lateral movement of the first member.

The lubricant composition can be used as a lubricant in any system, device or apparatus that includes mutually contiguous surfaces which displace (e.g., slide) relative to one another. FIG. 2 is a schematic illustration of an apparatus 200. The apparatus 200 can be used to test the lubricating properties of lubricant composition described herein. The apparatus 200 includes a first member 202 and a second member 204.

The first member 202 can be formed from any suitable material such as, for example, metals (iron, copper, brass, aluminum, steel, etc.), alloys, ceramics, plastics, polymers, etc. The first member 202 includes a first surface 203, which is substantially flat. As used herein, the term "substantially flat" means that the surface may include a number of de minimus contours, ridges, crevices, bumps or features which can commonly result during manufacturing of such a flat surface and as would be understood by the person skilled in the art.

A lubricant is disposed on the first surface 203. The lubricant includes an oil including a plurality of long-chain hydrocarbon molecules, and a quantity of a catalytically active metal-organic additive mixed with the oil. The metal-organic additive is formulated to fragment at least a portion of the long-chain hydrocarbon molecules of the oil into at least one of dimers and trimers under the influence of mechanical and/or thermal loading. For example, the mechanical loading exerted between the first member 202 and the second member 204 at which the metal-organic additive fragments the long-chain hydrocarbons can be in the range of 20 MPa to 5 GPa (e.g., 20 MPa, 40 MPa, 60 MPa, 80 MPa, 100 MPa, 200 MPa, 300 MPa, 400 MPa, 500 MPa, 600 MPa, 700 MPa, 800 MPa, 900 MPa, 1 GPa, 2 GPa, 3 GPa, 4 GPa or 5 GPa inclusive of all ranges and values therebetween). Furthermore, the thermal loading or temperature between the first member 202 and second member 204 at which the metal-organic additive fragments the long-chain hydrocarbons can be in the range of 20 degrees Celsius to 300 degrees Celsius (e.g., 20, 30, 40, 50, 60, 70, 80, 90, 100, 120, 140, 160, 180, 200, 220, 240, 260, 280 or 300 degrees Celsius inclusive of all ranges and values therebetween).

The lubricant can include any of the lubricant compositions described before herein. The carbon particles and/or metal particles (e.g. pure metal, metal oxide, metal nitride, metal carbide or metal sulfide) produced by the catalytic fragmenting of the long-chain hydrocarbon of the oil are disposed on the first surface in the form of a carbon-based film, a metal-based film or a combination thereof. The film in combination with the oil in the lubricant composition provides a lower coefficient of friction, and a more stable and long lasting lubricant.

A second member 204 having a second surface 205 is positioned on the first surface 203 of the first member such that the second surface 205 of the second member is positioned on the lubricant disposed on the first surface 203. The second member 204 can be formed from any suitable material such as, for example, metals (iron, copper, brass, aluminum, steel, etc.), alloys, ceramics, plastics, polymers, etc. The second surface 205 is circular such that the second member 204 can roll or slide on the surface. The first member 202 is configured to reciprocate in the direction shown by the arrow B relative to the second member 204 while the second member 204 is pushed downwards on the first surface 203 of the first member 202 in a direction shown by the arrow A. The second surface 205 of the second member 204 therefore slides on the first surface 203 of the first member 204 as the first member 204 reciprocates or displaces. The first member 202 can be reciprocated at any suitable rpm. The apparatus 200 can thus be used to study the coefficient of friction and physical properties of the lubricant compositions described herein, as described below.

EXPERIMENTAL EXAMPLES

FIGS. 3A-C, left panels are 3D profilometry and optical images of the second surface 205 of the second member 204, and FIGS. 3A-C right panels are optical images of the first surface 203 of the first member 202 included in the apparatus 200 of FIG. 2. The 3D profilometry profiles and optical images are taken after the first surface 203 and the second surface 205 have slid, rubbed, moved or otherwise displaced over each other with various lubricants disposed therebetween. FIG. 3D is a plot of the friction coefficient of the first surface 203 obtained with each of the lubricant. The apparatus 200 temperature was maintained at 100 degrees Celsius and a load of 350 N was exerted on the second member 204 in the direction shown by the arrow A in FIG. 2 to transmit the force to the first surface 203 of the first member 202. The contact pressure was between 0.1 GPa and 0.8 GPa. The first member 202 was reciprocated at 300 rpm (i.e., 5 Hz), with a stroke length (i.e., displacement distance) of 6 mm. The second member 204 included an AISI 52100 smooth cylinder and the experiments were performed for 3,600 seconds. The same experimental conditions were used for each of the experimental examples described herein FIG. 3A left panel shows profilometry profiles and an optical image of the second member 204, and FIG. 3A right panel shows an optical image of the first member 202 with a PAO10 oil disposed on the first surface 203 of the first member 202 and used as the lubricant. The PAO10 oil is a commonly used base oil in synthetic engine oils for automotive applications. As shown in FIG. 3D, at a force of 0.1 GPa significant markings were observed on each of the first surface 203 and the second surface 205, and the PAO10 oil provided an average coefficient of friction of about 0.12 at 0.1 GPa.

FIG. 3B left panel show profilometry profiles and an optical image of the second member 204, and FIG. 3B right panel shows an optical image of the first member 202 with a PAO10 oil including 1,000 ppm of a nickel(II) acetylacetonate ($Ni(acac)_2$) metal-organic additive (PAO10+Ni) as described before herein, disposed on the first surface 203 of the first member 202 and used as the lubricant. As shown in FIG. 3D, the PAO10+Ni lubricant is able to withstand a force of 0.8 GPa before significant markings were observed on each of the first surface 203 and the second surface 205 and provided a coefficient of friction of about 0.07.

FIG. 3C left panel show profilometry profiles and an optical image of the second member 204, and FIG. 3C right panel shows an optical image of the first member 202 with a commercially available MOBIL1® synthetic oil (fully formulated oil) disposed on the first surface 203 of the first member 202 and used as the lubricant. As shown in FIG. 3D, at a force of 0.3 GPa significant markings were observed on each of the first surface 203 and the second surface 205, and the fully formulated oil provided an average coefficient of friction of about 0.12 at 0.3 GPa. Thus the PAO10+Ni lubricant provided markedly superior performance than conventional lubricants.

Figure 4B:
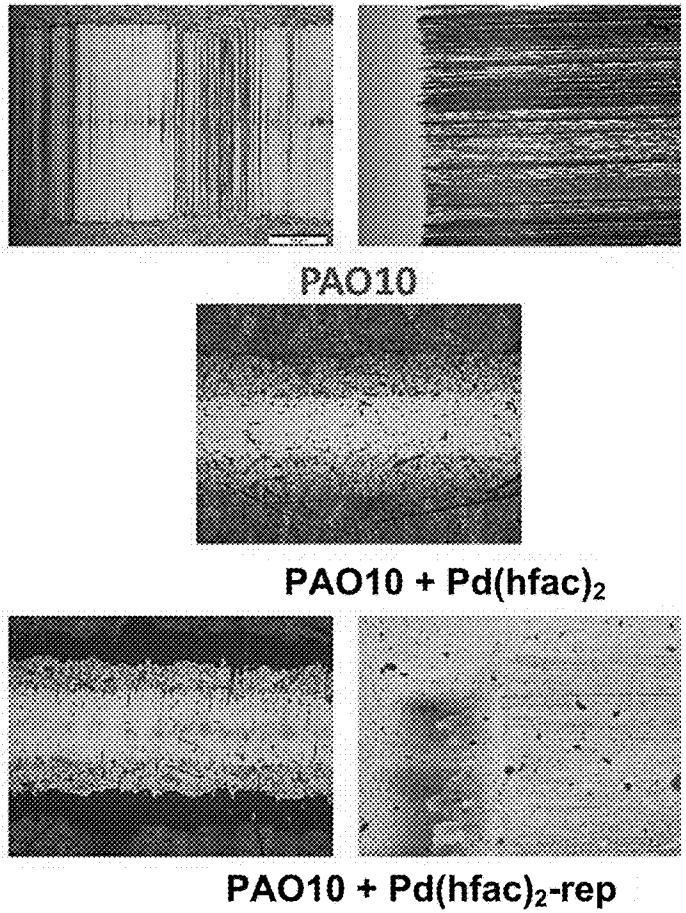
FIG. 4B are optical images of the first surface and the second surface after sliding the second surface on the first surface while the first member is reciprocating.
Figure 4A:
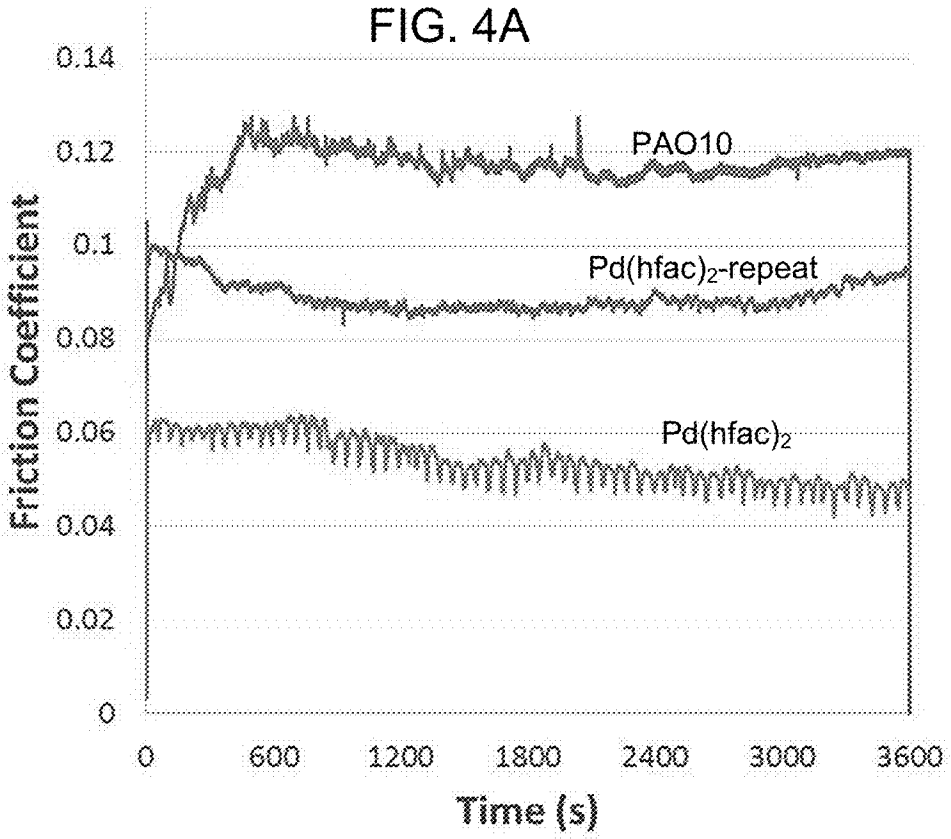
FIG. 4A is a plot of friction co-efficient profiles of the first surface of the first member resulting from various lubricants disposed on the first surface.
Figure 5B:
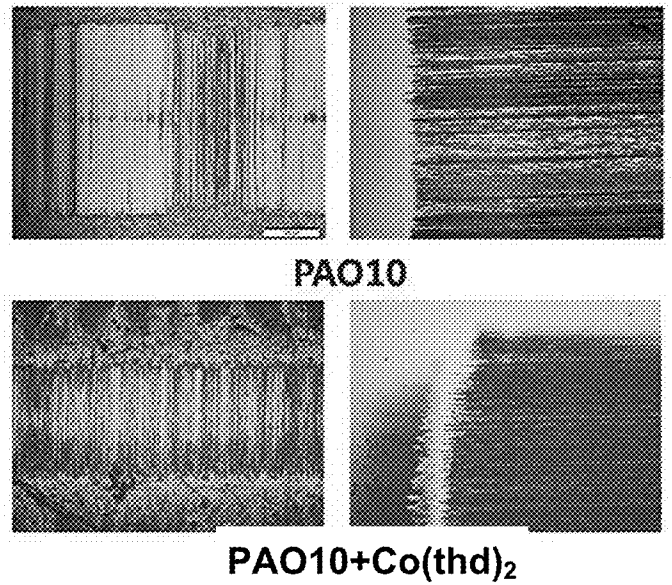
FIG. 5B are optical images of the first surface and the second surface after sliding the second surface on the first surface while the first member is reciprocating.

FIG. 4A is a plot of friction coefficients observed using a PAO10 lubricant and a lubricant composition including PAO10 and 1,000 ppm of Pd(II)hexafluoroacetylacetonate ($Pd(hfac)_2$) as the metal-organic additive (PAO10+$Pd(hfac)_2$), and FIG. 5B are optical images of the first surface 203 of the first member 202 and second surface 205 of second member 204 the apparatus 200 after running the apparatus 200 under the experimental conditions described before herein with the two lubricants. With the PAO10 oil a coefficient of friction of about 0.12 was observed. FIG. 4B top left panel is an optical image of the second surface 205 and FIG. 4B top right panel is an optical image of the first surface 203 of the apparatus 200 showing deep scratch marks visible on the first surface 203 and the second surface 205. A coefficient of friction of about 0.06 was observed for the PAO10+$Pd(hfac)_2$. FIG. 4B center panel shows an optical image of the second surface 205 with the PAO10+$Pd(hfac)_2$ lubricant revealing slight burring of the surface. The apparatus was subjected to another run with the PAO10+$Pd(hfac)_2$ lubricant (PAO10+$Pd(hfac)_2$-rep). The coefficient of friction of the first surface 203 increase to about 0.10 for the PAO10+$Pd(hfac)_2$-rep but remained below the PAO10 coefficient of friction. FIG. 4B bottom left panel shows the second surface 205 and the FIG. 4B bottom right panel shows the first surface 203 after the experiment revealing much shallower and smoother scratch marks relative to the PAO10 oil experiment.

Figure 5A:
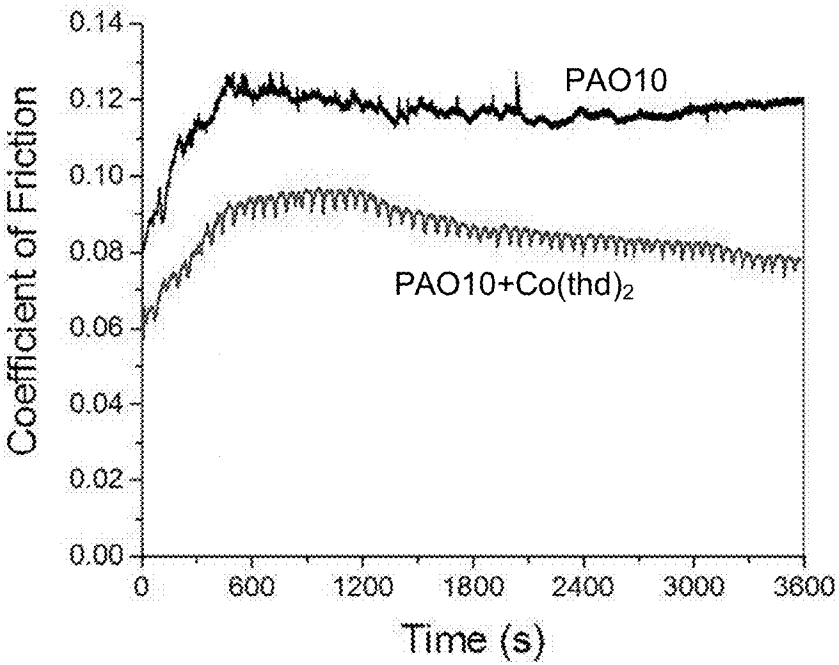
FIG. 5A is a plot of friction co-efficient profiles of the first surface of the first member resulting from various lubricants disposed on the first surface.

FIG. 5A is a plot of friction coefficients observed using a PAO10 lubricant and a lubricant composition including PAO10 and 1,000 ppm of Bis(2,2,6,6-tetramethyl-3,5-heptanedionato)cobalt(II) $Co(thd)_2$ as the metal-organic additive (PAO10+$Co(thd)_2$), and FIG. 5B are optical images of the first surface 203 of the first member 202 and second surface 205 of second member 204 after running the apparatus 200 under the experimental conditions described before herein with the two lubricants. With the PAO10 oil a coefficient of friction of about 0.12 was observed. FIG. 5B top left panel is an optical image of the second surface 205 (cylinder) and FIG. 5B top right panel is an optical image of the first surface 203 (flat surface) of the apparatus 200 showing deep scratch marks visible on the first surface 203 and the second surface 205. In contrast, a coefficient of friction of about 0.09 was observed for the PAO10+$Co(thd)_2$ lubricant. FIG. 5B bottom left panel shows the second surface 205 and the FIG. 5B bottom right panel shows the first surface 203 after the experiment revealing smoother scratch marks relative to the PAO10 oil experiment.

Figure 6:
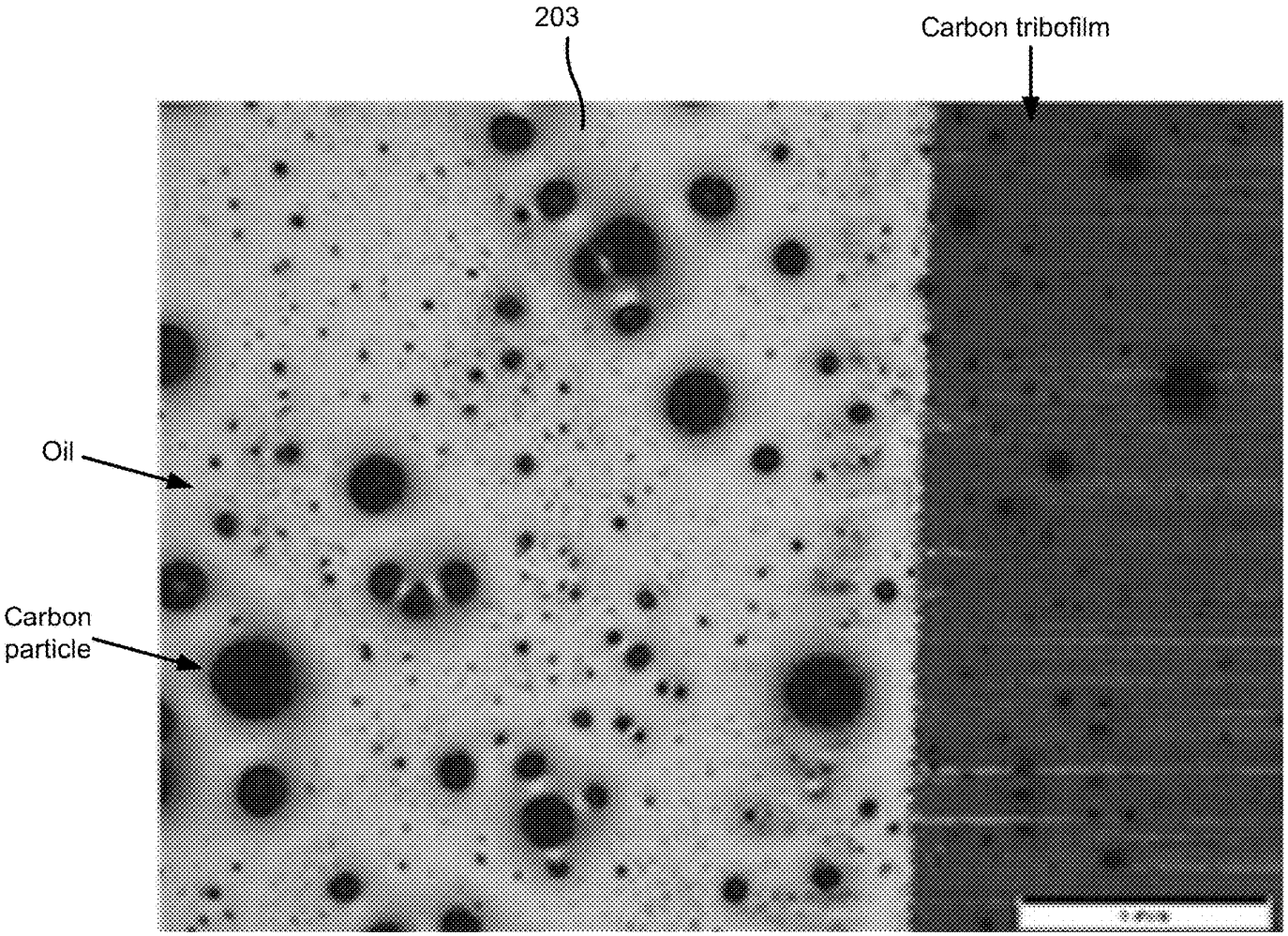
FIG. 6 is an optical image of a surface which includes a lubricant composition having a poly-alpha-olefin (PAO) oil including a catalytically active nickel based additive mixed therein disposed on the surface; the left portion of the surface shows carbon particles include in the oil on the surface while right portion of the surface shows a carbon based boundary layer or carbon tribofilm disposed on the surface after the second surface of the second member of FIG. 2 has slid over the surface with the surface reciprocating.

FIG. 6 is an optical image of the first surface 203 of the first member 202 with the PAO+Ni lubricant composition described above disposed thereon. The left portion of the first surface 203 shows carbon particles included in the PAO+Ni lubricant composition dispersed on the surface. The right portion of FIG. 6 shows the first surface 203 after the second surface 205 of the second member 204 was pressed on the surface and the first member 202 was reciprocated relative to the second member 204. Under the influence of the mechanical loading exerted by the second member 204 and thermal loading or heat produced between the first surface 203 and the second surface 205 due to rubbing or sliding action, a carbon based boundary layer or a carbon tribofilm is deposited on the first surface 203. A similar carbon tribofilm is also deposited on the second surface 205 (not shown).

Figure 7:
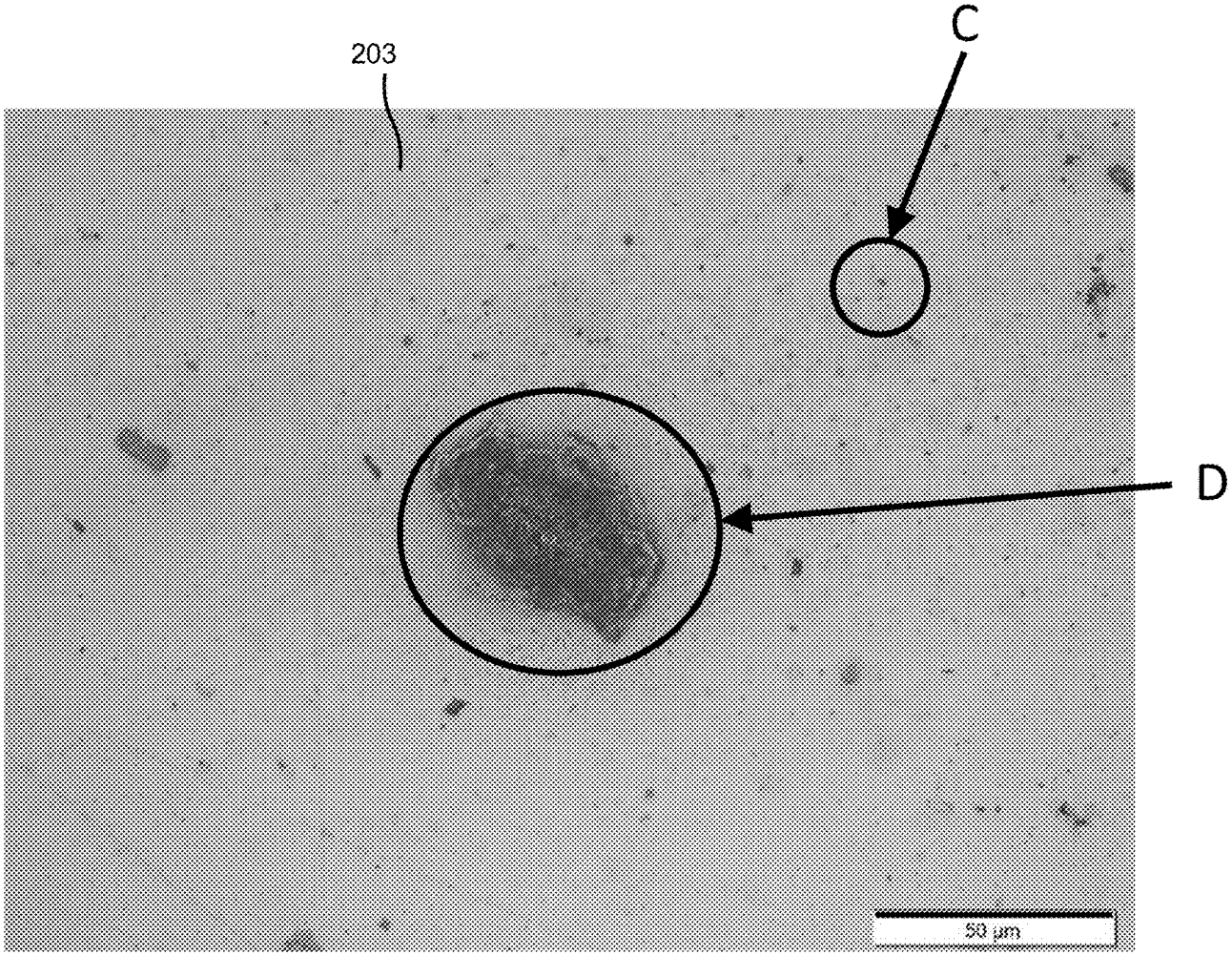
FIG. 7 is an optical image of a surface having a poly-alpha-olefin (PAO) oil including a catalytically active nickel based additive mixed therein disposed on the surface; a first portion of the surface shown by the arrow C has only the PAO oil disposed thereon, and a second portion of the surface shown by the arrow D includes the PAO oil and the nickel based additive which results in the deposition of carbon tribofilm of fragmented dimers and trimers on the surface.
Figure 8:
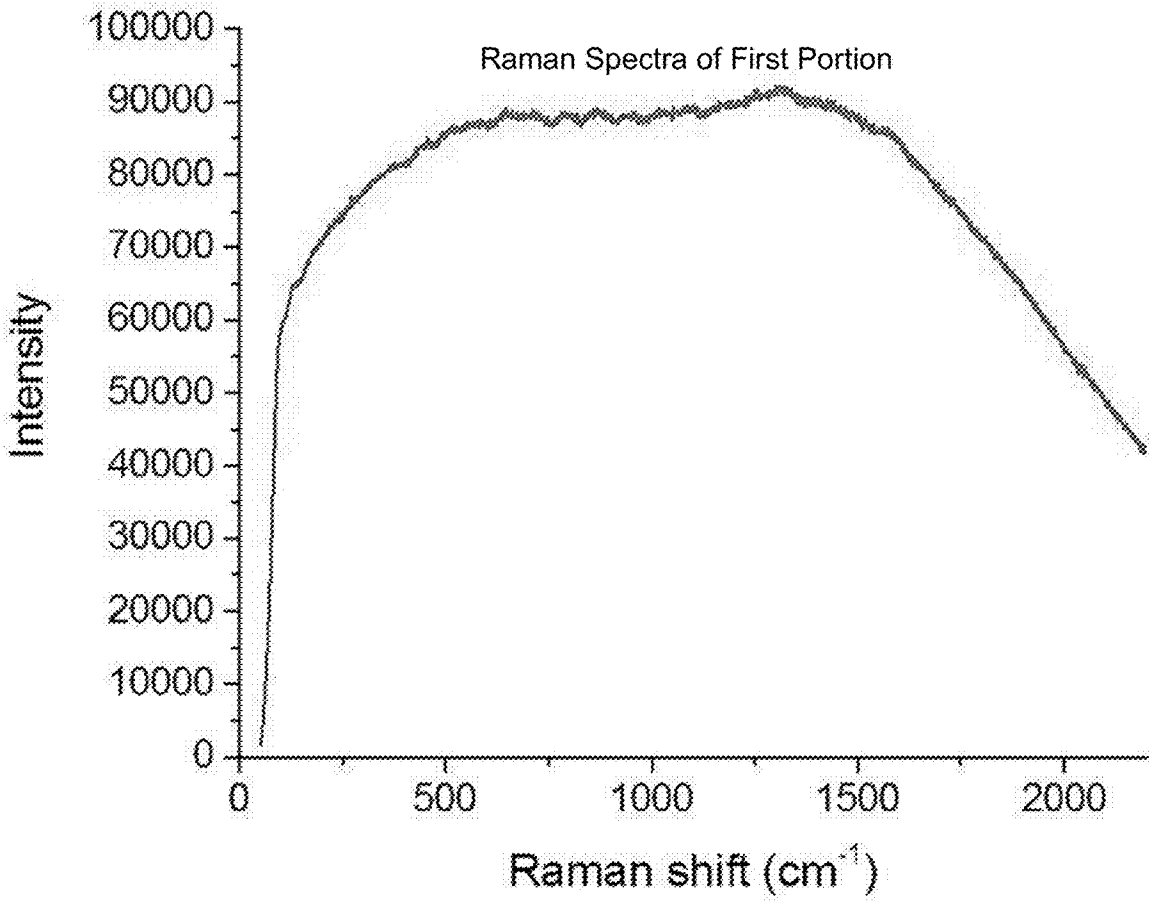
FIG. 8 is a Raman spectrum of the first portion of FIG. 7 which indicates a fluorescent signal attributed to steel surface with the PAO oil.
Figure 9:
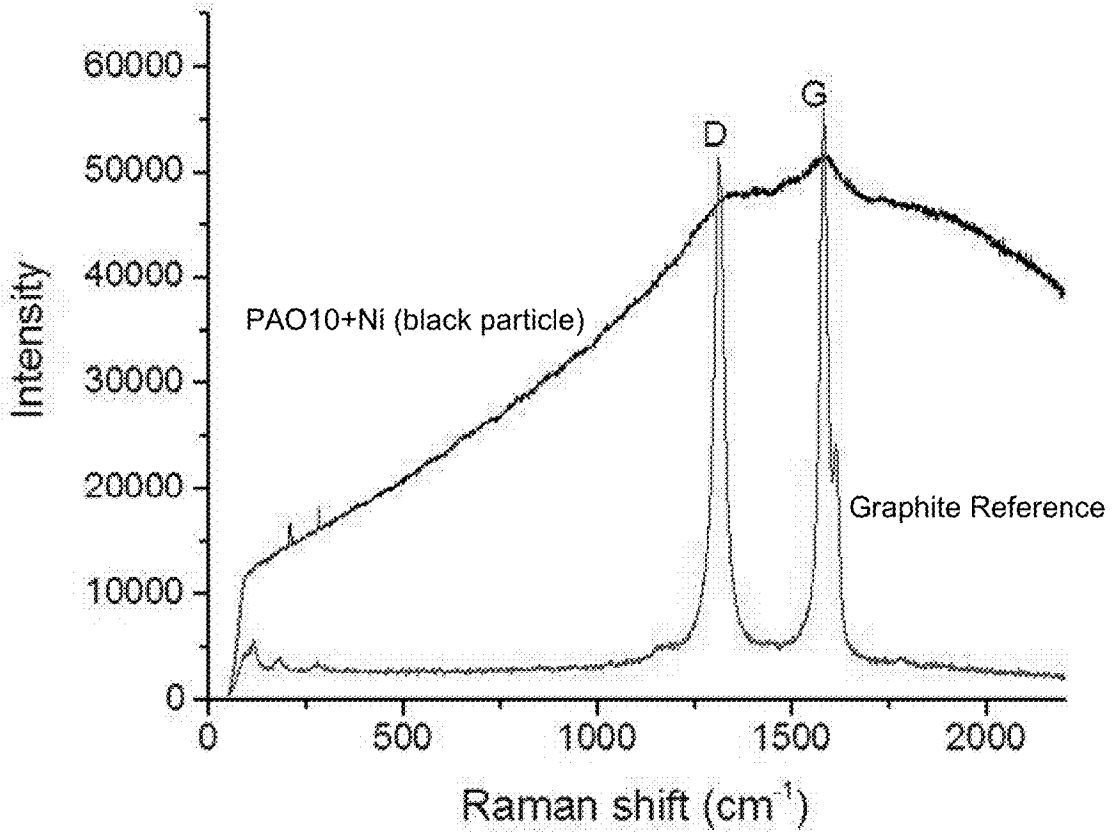
FIG. 9 is a Raman spectrum of the second portion of FIG. 6 along with a graphite reference spectrum, which indicates the presence of a carbon based tribofilm or boundary film that resulted from fragmented dimers and trimers on the first surface.

FIG. 7 is an optical image of the first surface 203 of the first member 202 with the PAO oil+Ni lubricant composition described above disposed thereon. A first portion of the first surface 203 indicated by the arrow C includes only the PAO oil, while a second portion of the oil indicated by the arrow D includes a carbon particle, which can include a plurality of carbon dimers and/or trimers, for example generated under the influence of mechanical and thermal loading. The carbon particle is produced by the fragmenting of the long-chain hydrocarbons of the PAO oil catalyzed by the $Ni(acac)_2$ metal-organic additive included in the PAO oil to produce carbon trimers and dimers, which are then disposed on the first surface 203. FIG. 8 shows a Raman spectra of the first portion and FIG. 9 shows a Raman spectra of the second portion along with a Raman spectra of a graphite reference. The Raman spectra of FIG. 8 shows no peaks associated with carbon dimers and trimers indicating that all the fluorescence can be attributed to the PAO oil. In contrast, the Raman spectra of the second portion (FIG. 9) which includes the black particle, includes peaks which correspond to the D and G peaks of graphite.

This confirms that the $Ni(acac)_2$ metal-organic additive fragments the PAO oil to deposit carbon dimers or trimers on the first surface 203. When such a lubricant is disposed between the mutually contiguous surfaces of two or more moving parts (e.g., the first surface 203 and the second surface 205) a plurality of carbon particles will be present between the two surfaces (e.g., the first surface 203 and the second surface 205) because of the fragmentation and the mechanical and thermal loading between the mutually contiguous surfaces or moving parts. As the parts move relative to each other while remaining in the mutually contiguous configuration, the surfaces of the parts will rub or slide against each other. This spreads the carbon particles on the surfaces until a carbon-based boundary film is formed on each of the surface. The carbon based boundary film in combination with the base oil provide superior, robust and long-lasting lubrication to the moving parts. Furthermore, the metal included in the metal-organic additive can also be disposed on the surfaces of the mutually contiguous parts providing additional lubrication.

As used herein, the singular forms "a", "an" and "the" include plural referents unless the context clearly dictates otherwise. Thus, for example, the term "a member" is intended to mean a single member or a combination of members, "a material" is intended to mean one or more materials, or a combination thereof.

As used herein, the terms "about" and "approximately" generally mean plus or minus 10% of the stated value. For example, about 0.5 would include 0.45 and 0.55, about 10 would include 9 to 11, about 1000 would include 900 to 1100.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Other substitutions, modifications, changes and omissions may also be made in the design, operating conditions and arrangement of the various exemplary embodiments without departing from the scope of the present invention.

What is claimed is:

1. A lubricant composition, comprising:

an oil including a plurality of long-chain hydrocarbon molecules; and a quantity of a catalytically active metal-organic additive mixed with the oil, the metal-organic additive formulated to fragment at least a portion of the long-chain hydrocarbon molecules of the oil into at least one of dimers and trimers under the influence at least one of a mechanical loading and a thermal loading.

2. The lubricant composition of claim 1, wherein the oil includes at least one of a poly-alpha-olefin oil, an ester based oil, a silicone based oil, a plant oil, a vegetable oil, polyalkylene glycol based oil or a fluorocarbon based oil.

3. The lubricant composition of claim 1, wherein the metal-organic additive includes a compound of a catalytic metal, the metal including at least one of Sc, Ti, V, Cr, Mn, Fe, Co, Ni, Cu, Zn, Y, Zr, Nb, Mo, Tc, Ru, Rh, Pd, Ag, Cd, Hf, Ta, W, Re, Os, Ir, Pt, Au, Hg, Rf, Db, Sg, Bh, Hs, Mt, Ds, Rg or Cn.

4. The lubricant composition of claim 3, wherein the metal-organic additive includes oxides of the catalytic metal.

5. The lubricant composition of claim 1, wherein the metal-organic additive includes a compound of formula I:

$$(X_nR_y)_z \quad \text{(I)}$$

where:

X is Sc, Ti, V, Cr, Mn, Fe, Co, Ni, Cu, Zn, Y, Zr, Nb, Mo, Tc, Ru, Rh, Pd, Ag, Cd, Hf, Ta, W, Re, Os, Ir, Pt, Au, Hg, Rf, Db, Sg, Bh, Hs, Mt, Ds, Rg or Cn;

n is 1, 2 or 3;

R is Cl, Br, I, F, O, C, S, SH or N;

y is 1, 2 or 3; and z is 1, 2 or 3.

6. The lubricant composition of claim 1, wherein the metal-organic additive includes a metal beta-diketonate.

7. The lubricant composition of claim 6, wherein the metal-organic additive includes a compound of formula II:

(II)

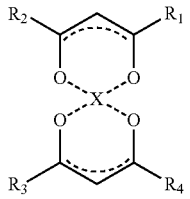

where:

X is Sc, Ti, V, Cr, Mn, Fe, Co, Ni, Cu, Zn, Y, Zr, Nb, Mo, Tc, Ru, Rh, Pd, Ag, Cd, Hf, Ta, W, Re, Os, Ir, Pt, Au, Hg, Rf, Db, Sg, Bh, Hs, Mt, Ds, Rg or Cn; and $R_1$, $R_2$, $R_3$ and $R_4$ are alkyl or alkyl halide.

8. The lubricant composition of claim 7, where X is Ni or Cu.

9. The lubricant composition of claim 1, wherein the metal-organic additive includes at least one of $(XR)_3$, $X(dmae)_2$, $X(dmap)_2$, $X(deap)_2$, $X(OCR_2CH_2NHR')_2$, $[X(sBu\text{-}amd)]_2$, $[X(iPr\text{-}amd)]_2$, $[X(iPr\text{-}guan)]_2$, $[X(dtip)]_2$, X(dki)(vtms), X(hfac)(vtms), X(hfac)(vtmos), X(nhc)(hmds) and $[X(hmds)]_4$, where:

X is Sc, Ti, Y, Cr, Mn, Fe, Co, Ni, Cu or Zn; and

R and R' are alkyl or alkyl halide.

10. The lubricant composition of claim 1, wherein the metal-organic additive comprises a compound of formula III:

(III)

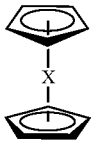

where:

X is Sc, Ti, V, Cr, Mn, Fe, Co, Ni, Cu, Zn, Y, Zr, Nb, Mo, Tc, Ru, Rh, Pd, Ag, Cd, Hf, Ta, W, Re, Os, Ir, Pt, Au, Hg, Rf, Db, Sg, Bh, Hs, Mt, Ds, Rg or Cn.

11. An apparatus, comprising;

a first member including a first surface;

a lubricant disposed on the first surface, the lubricant comprising:

an oil including a plurality of long-chain hydrocarbon molecules, and a quantity of a catalytically active metal-organic additive mixed with the oil, the metal-organic additive having catalytic activity to fragment at least a portion of the long-chain hydrocarbon molecules of the oil into at least one of dimers and trimers under the influence of at least one of a mechanical loading and a thermal loading;

the metal organic additive selected from a group consisting of a compound of formula I, a compound of formula II, and a compound of formula III, where the compound of formula I is $(X_nR_y)_z$ X is Sc, Ti, V, Cr, Mn, Fe, Co, Ni, Cu, Zn, Y, Zr, Nb, Mo, Tc, Ru, Rh, Pd, Ag, Cd, Hf, Ta, W, Re, Os, Ir, Pt, Au, Hg, Rf, Db, Sg, Bh, Hs, Mt, Ds, Rg or Cn; n is 1,2 or 3; R is Cl, Br, I, F, O, C, S, SH or N; y is 1, 2 or 3; and z is 1, 2 or 3;

where the compound of formula II is

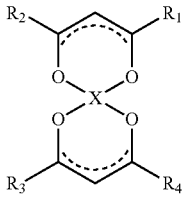

where: X is Sc, Ti, V, Cr, Mn, Fe, Co, Ni, Cu, Zn, Y, Zr, Nb, Mo, Tc, Ru, Rh, Pd, Ag, Cd, Hf, Ta, W, Re, Os, Ir, Pt, Au, Hg, Rf, Db, Sg, Bh, Hs, Mt, Ds, Rg or Cn; and $R_1$, $R_2$, $R_3$ and $R_4$ are alkyl or alkyl halide, where the compound of formula II is

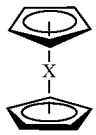

where: X is Sc, Ti, V, Cr, Mn, Fe, Co, Ni, Cu, Zn, Y, Zr, Nb, Mo, Tc, Ru, Rh, Pd, Ag, Cd, Hf, Ta, W, Re, Os, Ir, Pt, Au, Hg, Rf, Db, Sg, Bh, Hs, Mt, Ds, Rg or Cn; and a second member including a second surface, the second surface positioned on the lubricant disposed on the first surface, the first member positioned relative to the second surface of the second member such that the second surface is engaged with and slidable on the lubricant.

12. The apparatus of claim 11, wherein the oil includes at least one of a poly-alpha-olefin oil, an ester based oil, a silicone based oil, a plant oil, a vegetable oil, a polyalkylene glycol based oil or a fluorocarbon based oil.

13. The apparatus of claim 11, wherein the metal-organic additive includes the compound of formula I:

$(X_nR_y)_z$ (I)

where:

X is Sc, Ti, V, Cr, Mn, Fe, Co, Ni, Cu, Zn, Y, Zr, Nb, Mo, Tc, Ru, Rh, Pd, Ag, Cd, Hf, Ta, W, Re, Os, Ir, Pt, Au, Hg, Rf, Db, Sg, Bh, Hs, Mt, Ds, Rg or Cn;

n is 1, 2 or 3;

R is Cl, Br, I, F, O, C, S, SH or N;

y is 1, 2 or 3; and z is 1, 2 or 3.

14. The apparatus of claim 11, wherein the metal-organic additive includes the compound of formula II:

(II)

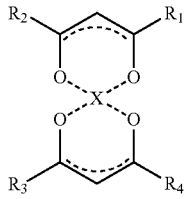

where:

X is Sc, Ti, V, Cr, Mn, Fe, Co, Ni, Cu, Zn, Y, Zr, Nb, Mo, Tc, Ru, Rh, Pd, Ag, Cd, Hf, Ta, W, Re, Os, Ir, Pt, Au, Hg, Rf, Db, Sg, Bh, Hs, Mt, Ds, Rg or Cn; and $R_1$, $R_2$, $R_3$ and $R_4$ are alkyl or alkyl halide.

15. The apparatus of claim 11, wherein the metal-organic additive includes at least one of $(XR)_3$, $X(dmae)_2$, $X(dmap)_2$, $X(deap)_2$, $X(OCR_2CH_2NHR')_2$, $[X(sBu\text{-}amd)]_2$, $[X(iPr\text{-}amd)]_2$, $[X(iPr\text{-}guan)]_2$, $[X(dtip)]_2$, X(dki)(vtms), X(hfac)(vtms), X(hfac)(vtmos), X(nhc)(hmds) and $[X(hmds)]_4$, where:

X is Sc, Ti, Y, Cr, Mn, Fe, Co, Ni, Cu or Zn;

R and R' are alkyl or alkyl halide.

16. The apparatus of claim 11, wherein the metal-organic additive comprises the compound of formula III:

(III)

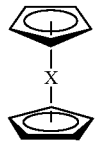

where:

X is Sc, Ti, V, Cr, Mn, Fe, Co, Ni, Cu, Zn, Y, Zr, Nb, Mo, Tc, Ru, Rh, Pd, Ag, Cd, Hf, Ta, W, Re, Os, Ir, Pt, Au, Hg, Rf, Db, Sg, Bh, Hs, Mt, Ds, Rg or Cn.

17. A method of preparing a lubricant, comprising:

providing an oil including a plurality of long-chain hydrocarbon molecules;

adding a predetermined quantity of a catalytically active metal-organic additive to the oil, the metal-organic additive formulated to fragment at least a portion of the long-chain hydrocarbon molecules of the oil into at least one of dimers and trimers under the influence of at least one of a mechanical loading and a thermal loading; and mixing the metal-organic additive with the oil to homogenously distribute the metal-organic additive in the oil.

18. The method of claim 17, wherein the oil includes at least one of a poly-alpha-olefin oil, an ester based oil, a silicone based oil, a plant oil, a vegetable oil, a polyalkylene glycol based oil or a fluorocarbon based oil.

19. The method of claim 17, wherein the metal-organic additive includes a compound of formula I:

$$(X_nR_y)_z \quad \text{(I)}$$

where:

X is Sc, Ti, V, Cr, Mn, Fe, Co, Ni, Cu, Zn, Y, Zr, Nb, Mo, Tc, Ru, Rh, Pd, Ag, Cd, Hf, Ta, W, Re, Os, Ir, Pt, Au, Hg, Rf, Db, Sg, Bh, Hs, Mt, Ds, Rg or Cn;

n is 1, 2 or 3;

R is Cl, Br, I, F, O, C, S, SH or N;

y is 1, 2 or 3; and z is 1, 2 or 3.

20. The method of claim 17, wherein the metal-organic additive includes a compound of formula II:

(II)

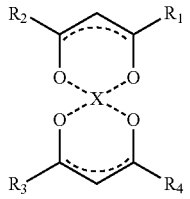

where:

X is Sc, Ti, V, Cr, Mn, Fe, Co, Ni, Cu, Zn, Y, Zr, Nb, Mo, Tc, Ru, Rh, Pd, Ag, Cd, Hf, Ta, W, Re, Os, Ir, Pt, Au, Hg, Rf, Db, Sg, Bh, Hs, Mt, Ds, Rg or Cn; and $R_1$, $R_2$, $R_3$ and $R_4$ are alkyl or alkyl halide.

21. The method of claim 17, wherein the metal-organic additive includes at least one of $(XR)_3$, $X(dmae)_2$, $X(dmap)_2$, $X(deap)_2$, $X(OCR_2CH_2NHR')_2$, $[X(sBu\text{-}amd)]_2$, $[X(iPr\text{-}amd)]_2$, $[X(iPr\text{-}guan)]_2$, $[X(dtip)]_2$, X(dki)(vtms), X(hfac)(vtms), X(hfac)(vtmos), X(nhc)(hmds) and $[X(hmds)]_4$, where:

X is Sc, Ti, Y, Cr, Mn, Fe, Co, Ni, Cu or Zn;

R and R' are alkyl or alkyl halide.

22. The method of claim 17, wherein the metal-organic additive comprises a compound of formula III:

(III)

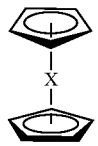

where:

X is Sc, Ti, V, Cr, Mn, Fe, Co, Ni, Cu, Zn, Y, Zr, Nb, Mo, Tc, Ru, Rh, Pd, Ag, Cd, Hf, Ta, W, Re, Os, Ir, Pt, Au, Hg, Rf, Db, Sg, Bh, Hs, Mt, Ds, Rg or Cn.

* * * * *